US005198036A

United States Patent [19]

Sotolongo

[11] Patent Number: 5,198,036

[45] Date of Patent: Mar. 30, 1993

[54] LIFTING WHEELED ARRANGEMENT FOR ROLLERS

[76] Inventor: Enrique I. Sotolongo, 10 Bundick Ct., Kenner, La. 70065

[21] Appl. No.: 317,298

[22] Filed: Mar. 1, 1989

Related U.S. Application Data

[63] Continuation-in-part of Ser. No. 96,375, Sep. 14, 1987, abandoned.

[51] Int. Cl.[5] ..... B08B 1/00; B08B 7/00

[52] U.S. Cl. ..... 134/6; 134/6; 15/98; 15/105; 15/79.1; 15/230.11; 15/144.2

[58] Field of Search ..... 134/6; 15/79 R, 98, 15/105, 230.11, 144 A

[56] References Cited

U.S. PATENT DOCUMENTS

| | | | |
|---|---|---|---|
| 1,525,617 | 2/1925 | Mills | 15/79 R |
| 3,967,339 | 7/1976 | Newman | 134/6 |
| 4,358,123 | 11/1982 | Richards | 15/79 R |

FOREIGN PATENT DOCUMENTS 651625 11/1935 Fed. Rep. of Germany .

*Primary Examiner*—Theodore Morris
*Assistant Examiner*—Zeinab El-Arini
*Attorney, Agent, or Firm*—C. Emmett Pugh

[57] ABSTRACT

A mounted bracket with wheels that attaches to existing holes on the carriage of a "Rol-Dri"(TM) roller or similar equipment for removing water from and simultaneously drying hard surfaces such as tennis courts. The purpose of the invention is to eliminate the need to lift and carry the roller dry or wet. While transporting the roller to and from the wet area or during the drying operation. This is accomplished by lowering the handle of the roller which places the wheels of the invention in contact with the ground thereby lifting the roller off of the ground. The user can pull the roller along by the wheels of the invention without having the roller in contact with the ground.

2 Claims, 3 Drawing Sheets

LIFTING WHEELED ARRANGEMENT FOR ROLLERS

REFERENCE TO A RELATED APPLICATION

This is a continuation-in-part application of patent application Ser. No. 07/096,375, filed Sep. 14, 1987, entitled "Lifted Wheeled Arrangement", now abandoned in favor of this application.

BACKGROUND OF INVENTION

1. Field of Invention

The present invention relates to water removing devices and more particularly to novel lifting device and method for use in conjunction with roller-type water removing devices. The present device is configured to facilitate easy lifting of an unbalanced, absorbent water removing device.

The present invention comprises a horizontally displaced wheel or roller arrangement attached to the carriage of the roller or sufficiently spaced so as to facilitate easy, stable lifting of the roller during the water removing process.

2. Prior Art & General Background

Today, removing water and drying hard surfaces, such a tennis courts, is predominantly done by using rollers, such as the "Rol-Dri" TM roller for removing water from and simultaneously drying hard surfaces, as shown in U.S. Pat. No. 3,967,339 issued Jul. 6, 1976. This roller will remove water from a tennis court by absorbing and pushing the water to the edge of the surface or to a drain. To continue drying the surface, the roller must be lifted and walked back to the starting point. Pulling the roller back to the starting point would pull water back on the dried surface.

Our experience has found that in drying the surface of a tennis court the average number of times a roller is lifted is approximately fifty times. This is very tiresome, specially when the roller that weighs about eight pounds dry and eighteen pounds wet remains wet and heavy after coming in contact with water. It is also necessary to lift the roller apparatus when replacing it to its storage position so as to avoid getting any dry surface wet.

The "Lifting Wheeled Arrangement" for rollers that removes water from and simultaneously dries hard surfaces will allow the user to eliminate lifting the roller while using it and thereby increasing the life of the roller.

A list of prior patents which may be of interest is presented below:

| Patent No. | Patentee(s) | Issue Date |
|---|---|---|
| 1,525,617 | Mills | 02/10/1925 |
| 3,967,339 | Newman | 07/06/1976 |
| 4,358,123 | Richards | 11/09/1982 |
| 651,625 (GDR) | Burkhard | 10/16/1937 |

Richards teaches an attachment for a ground traversing device specifically adapted for a broom or similar device and having a somewhat circular bracket engageable around the broom handle and an axle pivotally mounted on the bracket.

Mills teaches similarly a "U" configured axle pivotally connected via circular bracket to the handle of a push brush or broom.

Burkhard likewise teaches a similar configuration for a device connected via circular bracket to the broom handle for facilitating less tiresome operation of push brushes, brooms and the like.

The present invention is clearly distinguishable over the above cited prior art in that it teaches a lifting wheeled arrangement specifically designed to be attached to the carriage of water removing rollers, such as the "Rol-Dri" TM roller or the like for use in conjunction with tennis courts and the like, as opposed to the handle of the roller.

Mounting the arrangement to the carriage is essential to facilitate desirable operation of the present invention, as a mounting on the handle, as is taught in the prior art, would not work in the efficient manner contemplated by the present invention. The present roller to which the present invention is applied can weigh from twenty five to forty pounds, depending upon the content of water absorbed by the roller material.

Often the water is absorbed unevenly through the roller, such that one side of the roller may have more water than the other side, thereby creating an imbalance. If the lifting device was mounted as taught in the prior art, that is, on the handle, the roller would at best wobble and at worst tilt to one side lifting one of the wheels off of the ground and thereby making effective utilization of the lifting means as contemplated by the prior art impossible.

The mounting brackets on the present system are not "circular" brackets as contemplated in the prior art for connection to the handle, but are instead flat, somewhat rectilinear brackets adapted to be mounted to the carriage of the roller.

The mounting brackets are specifically designed to compensate for the potential imbalance contemplated above; the spaced mounting means as contemplated in the present invention would be unobtainable with the handle mounts as taught in the prior art.

For the present invention to operate as contemplated, it is imperative that this spaced mounting means be used; said means effectively distributes the contact point of the present bracket to the roller allowing the bracket to better compensate for an imbalance. Again, because of the spacing necessary for a balanced mounting, it is imperative that said means be mounted to the carriage of the roller and not to the handle, as taught in the prior art.

Further, the present invention is distinguishable from the prior art as the bracket had to be designed to lift a much heavier load than the prior art. As enumerated supra, the roller can weigh as much as 25–40 pounds, depending upon the degree of liquid saturation, porosity of the roller, etc. The objects lifted with the lifting brackets of the prior art weighed at most 5–15 pounds, thereby putting much less stress on their lifting brackets.

In addition to the heavy duty construction, the present invention's connection directly to the carriage and not the handle enables the user to take advantage of the full leverage potential of the handle, thereby more efficiently lifting the roller. Further, the roller means of the present invention are positioned somewhat to the rear of the mounting bracket and not below said bracket as is taught in the prior art; this positioning allows still further leverage potential.

This is in comparison to the prior art, which teaches a mounting bracket connected on the handle 1 to 2+ feet from the base, thereby providing much less efficient leveraged lifting means. Further, the rolling means of the prior art is taught in the form of 5+ inch wheels directly below said mounting means, further lessening the leverage potential. With the present invention, the additional efficiency as enumerated in the design of the lifting wheeled arrangement was necessary due to the need for leveraged lifting of a potentially heavy roller.

The present invention is entirely distinguishable from the prior art, said prior art not anticipating the unbalanced effect possible with the uneven saturation of liquid to the porous composition of the rollers; the mounting means is thus unobvious in light of what has been taught before.

GENERAL, SUMMARY DISCUSSION OF THE INVENTION

The primary objective of the invention is to provide an ancillary device to facilitate improved conveyance of "Rol-Dri" TM roller or similar equipment to and from the wet areas.

A second objective of the present invention is to provide a device having two wheels spaced in such a manner so as not to track water onto the dried surface, while far enough apart so as to adequately balance the roller. The invention is designed and attached so that the entire "Rol-Dri" roller or similar equipment is balanced by the invention when the handle is lowered.

A third objective of the present invention is to provide for a device which will attached to "Rol-Dri" TM rollers and similar equipment by using existing screw holes in the roller's design; and a fourth objective of the present invention is to provide for a device which is made of light weight and durable components so as to not add significant weight to the roller; a fifth objective of the present invention is to provide a device which is made of will not hinder the operation of the roller during the drying process.

The present invention will convey via lifting wheeled arrangement, a medium weight roller known in the trade as roller, or "Rol-Dri" TM, during prescribed steps of the process of utilizing said roller for removing water from a flat surface such as a tennis court. The utilization of the present invention in conjunction with the roller or "Rol-Dri" TM will greatly increase the efficiency and ease of removing liquids from flat surfaces such as tennis courts providing stable, leveraged means of lifting the roller while in the process of removing liquids. The invention comprises a wheeled device which attaches to the aforementioned roller's carriage in a manner so as to facilitate the lifting and conveying of the roller, during repositioning of the roller after each pushing stroke.

The old operation of the "Rol-Dri" TM is that of pushing the water off the court by rolling the roller forward to the edge of the surface, lifting the entire wet roller with both hands, walking back to a spot adjacent to the previous starting point, and setting the roller down to continue rolling more water forward to the edge of the surface until all water is removed. Because of the design and weight of the roller and its carriage it is very tiring and awkward to lift on a repeated basis. This is in comparison to the present invention, which when utilized in conjunction with the "Rol-Dri" TM essentially dispenses with the necessity of lifting the roller during the dragging process, implementing a leveraged, stable means of conveying the roller from one area to another.

The implementation of the present invention allows for the following improved procedure in the removal of liquids from flat surfaces utilizing the "Rol-Dri" TM or similar system roller devices. As with the old operation, the process begins by pushing water off the court by rolling the roller forward to the edge of the surface. Now, instead of lifting the roller with both hands, the handle is allowed to drop a few inches and, utilizing the leverage conveyed with the handle and present invention the roller is lifted in a balanced, stable position by the invention. The user can now proceed to walk back as before, and restart the process by simply raising the handle a few inches until the wheels are off the ground, allowing the roller to reestablish contact with the surface with its full weight being brought to bear on the roller.

The present invention thus eliminates any lifting of the drying roller apparatus during its use and eliminates the most tiring part of the process.

The present invention may be fabricated from relatively low-cost components. The preferred embodiment of the present invention comprises ancillary bracket with wheels which attaches to the carriage of the Rol-Dri water removing roller or similar equipment. It is designed to fit the carriage of the aforementioned Rol-Dri roller and other similar devices in such a manner as to achieve the above described objectives. The bracket of the present invention must be of certain dimensions so as to fit firmly to the carriage of the roller and the position of the wheels on the bracket must meet certain criteria as found by test and experimentation so that the comfortable raising and lowering movement of the handle will produce the desired objectives. The position and dimension of the bracket must be such that it provides a sufficient balancing effect when the roller is so lifted by the wheels, taking into account that the roller itself may at times be somewhat unbalanced in weight distribution due to uneven saturation of water in the porous material comprising the roller.

These and other objectives, features and advantages of the present invention will become more readily apparent upon reviewing the following detailed description of the preferred embodiment described below and taken in conjunction with the appended drawings.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED, EXEMPLARY EMBODIMENT(S)

Figure 1:
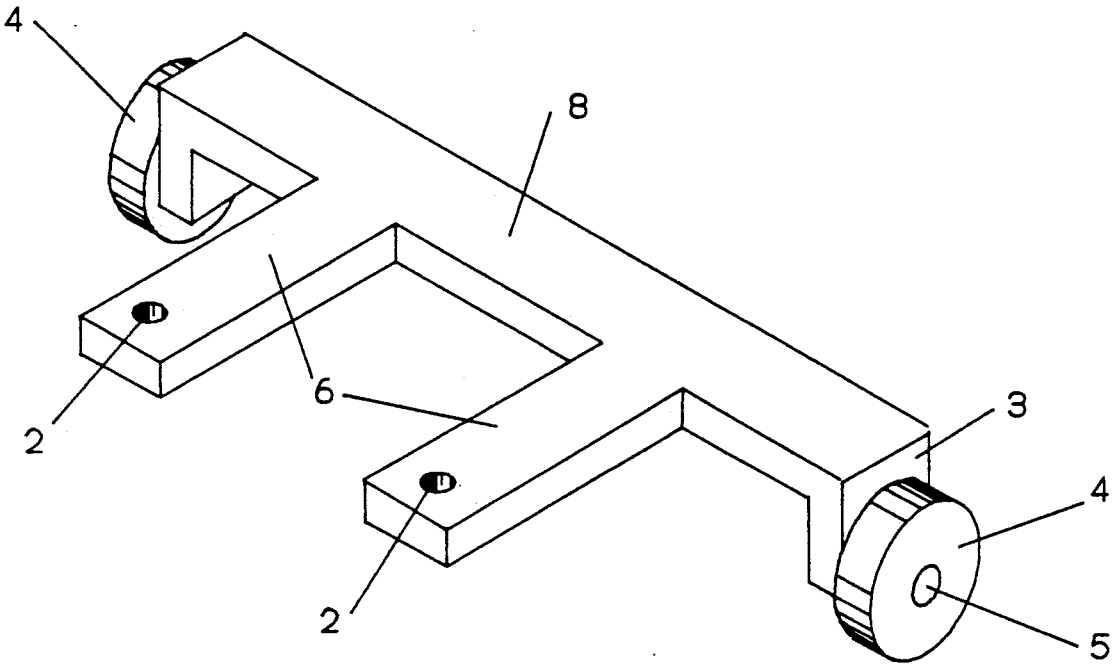
FIG. 1 is a perspective view of a preferred embodiment of a lifting wheeled arrangement for rollers for removing water from and simultaneously drying hard surfaces.
Figure 2:
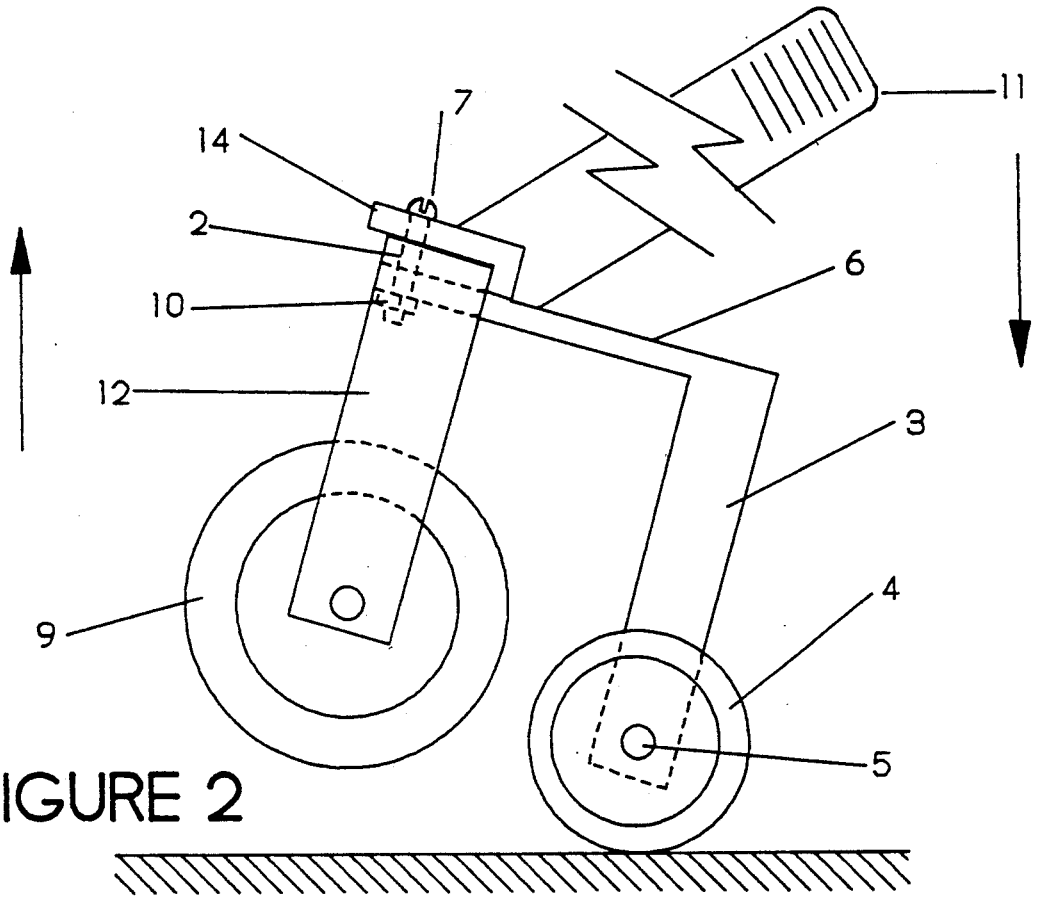
FIG. 2 is a side view of the invention attached to and lifting the Rol-Dri as it is being pulled back above the surface by the invention.
Figure 3:
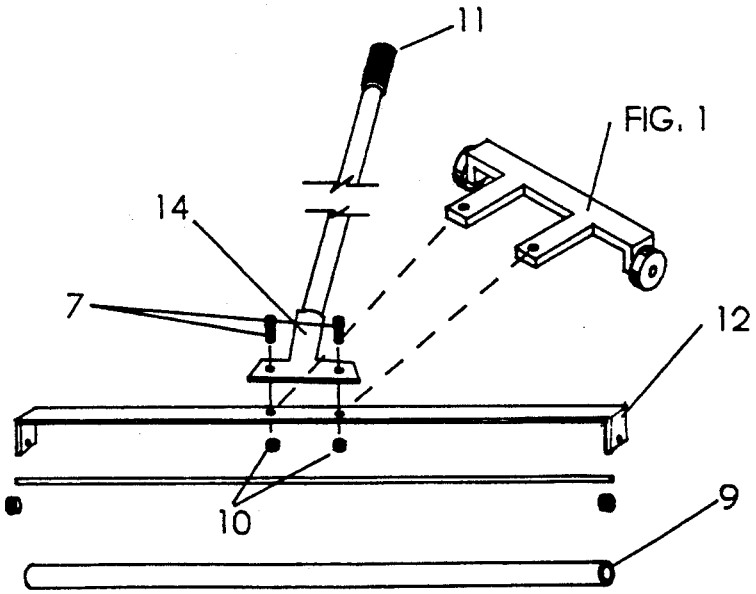
FIG. 3 is a perspective view of the invention and the exploded view of the roller device and where the invention attaches to the Rol-Dri roller for removing water from hard surfaces.

As shown in FIG. 1, the invention bracket 1 provides a means of supporting two small wheels 4 in a position so that when the roller FIG. 3, 9 is being used for pushing water to the edge of the surface the spacing between the wheels 4 and the ground is one quarter inch or greater. This is accomplished by designing the bracket 1 so that it has wheel mounting members 5 at the proper height from the surface to be dried when bracket 1 is attached to carriage 12 FIG. 2 through mounting holes 2. The two vertical trusses 3 are set far enough apart by a horizontal bar 8 so that the wheels 4 balance the roller device FIG. 3, 8 when the invention is being used to transport the roller, and yet not so far as to roll outside the dried path formed by the roller 9.

FIG. 2 shows a detailed side view of the invention balancing the roller 9 in a lifting position as it would be while being pulled back to another position by handle 11. Handle 11 has been lowered as indicated by the down arrow, thus pivoting the roller 9 up and lowering the wheels 4 to the ground. It also shows a detailed attachment of the mounting truss 6 to carriage 12 at mounting holes 2 wtih mounting bolt 7 and nuts 10.

FIG. 3 shows an exploded view of roller device 8 without the invention attached. The invention bracket 1 and aforementioned components are shown oriented along the same axis as the roller device 8 as it would be positioned during the attachment to the underside of carriage 12. Bolts 7 pass through handle socket 14, then carriage 12, then through mounting holes 2 and firmly secured by nuts 10.

FIGS. 4–9 show a view of the roller device 8 with the invention bracket 1 attached to the carriage 12 and the method of use with the preferred embodiment of the invention.

Figure 4:
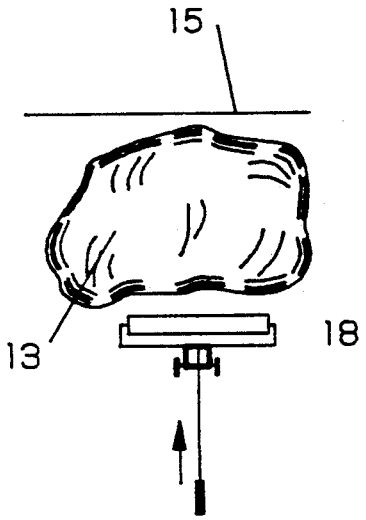
FIGS. 4–9 comprises diagrams illustrating the step by step operation of the Rol-Dri and of the present invention at work.

FIG. 4 is a view from above a roller device 8 positioned behind the water to be dried 13. The arrow indicates the direction the roller device 8 is being pushed.

Figure 5:
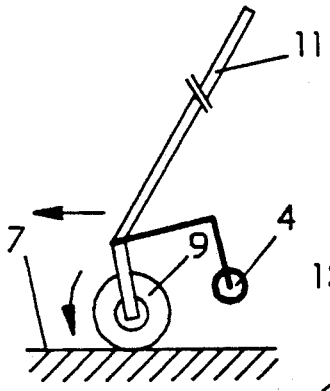

FIG. 5 is a side view of FIG. 4 and shows the long handle 11 of the roller device in its proper position, about forty three degrees with the ground 7 with the roller 9 in contact with the surface 7 and rolling while the roller device 8 moves forward. The wheels 4 of the invention are above the ground 7 so as not to hinder the action of the roller while drying the water 13.

Figure 6:
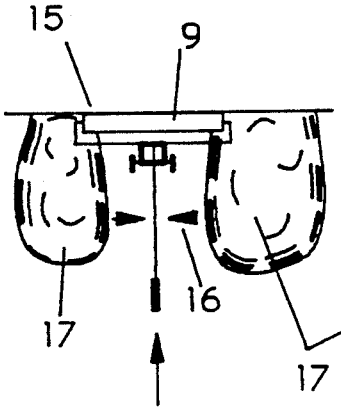

FIG. 6 is a top view that shows the roller 9 as it gets to the edge of the surface to be dried. Leaving a dried path 16 the width of the roller 9 immediately behind. It also shows how the water 17 that has been pushed aside 30 flows back into the dried path 16 from both sides, and how the only way to bring the roller back to reposition it would be to lift it above the water.

Figure 7:
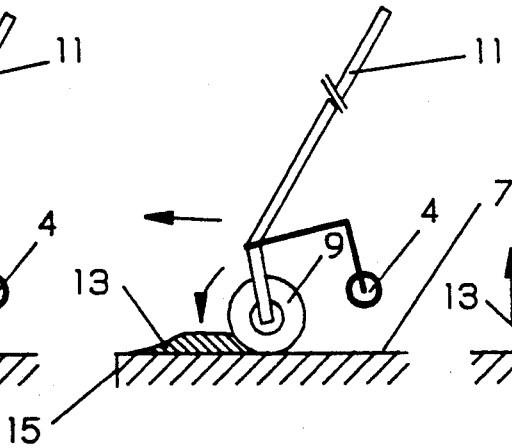

FIG. 7 is a side view of FIG. 6 and shows the action of the roller 9 with long handle at a forty three degree angle with the surface. The mounting wheels 4 of the invention are clear off of the ground and not hindering the effective use of the roller 9 as the roller moves forward pushing the water to the edge of the surface.

Figure 8:
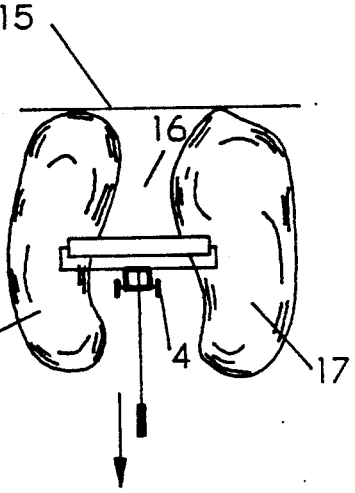

FIG. 8 shows the top view of the roller 9 being rolled back on the wheels 4 of the invention from where the roller 9 was at the end of the drying stroke so as to relocate it at a position adjacent to the starting position 18 in FIG. 4 to begin a second drying stroke forward. It also shows the roller 9 riding above the water 17 while the wheels 4 are in contact with the dried surface 16. Even if the water 17 has rolled back over the dried surface path 16 pulling the roller 9 back on the wheels 4 avoids rolling water away from the edge 15 since the small wheels 4 track little if any water and push none as would be done by the roller 9.

Figure 9:
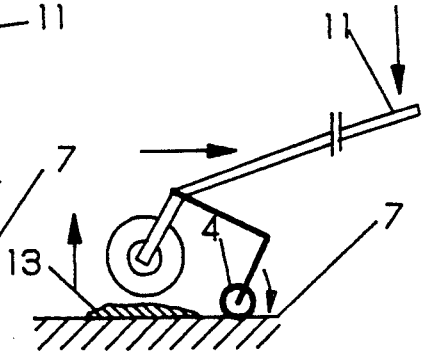

FIG. 9 shows a side view of FIG. 8 with the handle 11 of the roller device 8 in its down position at a thirty one degree angle to the surface and the roller 9 has pivoted up about the wheels 4 thus being raised one quarter inch or higher and not touching the water 13. The positions of the wheels 4 in relation to the rolling device is such that the rolling device is in nearly perfect balance while riding on the wheels 4 and being pulled back to restart the drying process at which point the handle 11 will be raised back to a position to push the water as in FIG. 4.

Having discussed the preferred embodiment of the present invention is specific detail, it should be understood that numerous modifications, additions and omissions in the details thereof are possible within the intended spirit and scope of the invention. It will be apparent to those skilled in the art as defined in the attached claims.

The embodiment(s) described herein in detail for exemplary purposes are of course subject to many different variations in structure, design, application and methodology. Because many varying and different embodiments may be made within the scope of the inventive concept(s) herein taught, and because many modifications may be made in the embodiment(s) herein detailed in accordance with the descriptive requirements of the law, it is to be understood that the details herein are to be interpreted as illustrative and not in a limiting sense.

What is claimed is:

1. A method of removing liquids from a flat surface, for example, a tennis court, utilizing a device including
   - a laterally extended water absorbing head,
   - a carriage attached to said head,
   - a long extended handle attached to said carriage, and
   - a lifting roller arrangement attached directly to said carriage below said handle; said method further comprising the following steps:
   - a) pushing the water off the surface by pushing said head via said handle to the edge of said surface;
   - b) lowering said handle until said lifting roller arrangement contacts the surface and lifts said head;
   - c) conveying said lifted head off the surface by rolling said lifting roller arrangement to the next desired area to have the water removed; and
   - d) lifting said handle until said lifting roller arrangement no longer contacts the surface and said head recontacts said surface.

2. A method of removing liquids from a flat surface having an edge, comprising the following steps:
   - a. implementing a water removing device comprising:
     - a cylindrical, laterally extended water absorbing head,
     - a carriage attached to said head,
     - a long extended handle attached to said carriage, and
     - a lifting roller arrangement attached directly to said carriage below said handle;
   - b. placing said head on the surface on or near the liquid;
   - c. applying force to said handle, rotating said head across the surface;
   - d. contacting said head to the liquid;

e. rotating said head to the edge of the surface;

f. lowering said handle until said lifting roller arrangement contacts the surface and lifts said head;

g. conveying said lifted head off the surface by rolling said lifting roller arrangement to the next desired area to have the liquid removed;

h. lifting said handle until said lifting roller arrangement no longer contacts the surface and said head recontacts the surface.

* * * * *